US012650255B2

(12) United States Patent
Runk et al.

(10) Patent No.: US 12,650,255 B2
(45) Date of Patent: Jun. 9, 2026

(54) SYSTEM FOR CONTROLLING A DEFROST OF A DUAL FLOW HEAT EXCHANGER

(71) Applicant: MAHLE INTERNATIONAL GMBH, Stuttgart (DE)

(72) Inventors: Robert Louis Runk, Lockport, NY (US); Scott Kent, Albion, NY (US)

(73) Assignee: MAHLE International GmbH, Stuttgart (DE)

( * ) Notice: Subject to any disclaimer, the term of this patent is extended or adjusted under 35 U.S.C. 154(b) by 104 days.

(21) Appl. No.: 18/388,913

(22) Filed: Nov. 13, 2023

(65) Prior Publication Data

US 2025/0155173 A1 May 15, 2025

(51) Int. Cl.

*F25B 40/02* (2006.01)
*F25B 47/02* (2006.01)
*F25B 49/00* (2006.01)

(52) U.S. Cl.

CPC ..... *F25B 47/02* (2013.01); *F25B 40/02* (2013.01); *F25B 49/005* (2013.01); *F25B 2347/02* (2013.01)

(58) Field of Classification Search

CPC ..... F25B 47/02; F25B 40/02
See application file for complete search history.

(56) References Cited

U.S. PATENT DOCUMENTS 3,350,895 A * 11/1967 Harnish ..... F25B 47/022 62/503
9,488,395 B2 11/2016 Matsumoto et al.
(Continued)

FOREIGN PATENT DOCUMENTS

CN 102918340 A 2/2013
CN 103644685 3/2014
(Continued)

OTHER PUBLICATIONS

Search Report & Written Opinion issued in PCT/EP2023/074327 (Nov. 9, 2023).
(Continued)

*Primary Examiner* — David J Teitelbaum
(74) *Attorney, Agent, or Firm* — Barnes & Thornburg

(57) ABSTRACT

A method of controlling the performance of a refrigeration system includes operating first and second heat exchangers, the first to remove heat from one or both of a space where the first heat exchanger is disposed or a component within the space where the first heat exchanger is disposed. The first heat exchanger has a first set of parallel tubes between manifolds, the second heat exchanger has a second set of parallel tubes between manifolds the first and second tubes alternating in spaces between each other; Refrigerant that flows through the first set of tubes additionally flows through the second set of tubes before the refrigerant again flows through the first set of tubes. Operating a second heat exchanger that is fluidly connected with both of the first set of tubes and the second set of tubes. In situations where a build-up of frost occurs upon one or more surfaces of the first heat exchanger during operation, continuing to operate the first heat exchanger to transfer heat from the refrigerant to the first medium thereby performing a defrost function upon the one or more surfaces of first heat exchanger.

20 Claims, 3 Drawing Sheets

(56) References Cited

U.S. PATENT DOCUMENTS

| | | | | |
|---|---|---|---|---|
| 9,752,803 | B2 | 9/2017 | Matter, III et al. | |
| 2004/0154331 | A1* | 8/2004 | Horiuchi | F28F 1/022 62/509 |
| 2006/0243432 | A1 | 11/2006 | Demuth et al. | |
| 2009/0027671 | A1 | 1/2009 | Jarrell | |
| 2010/0307172 | A1* | 12/2010 | Lifson | F24F 3/153 62/81 |
| 2013/0019617 | A1* | 1/2013 | Hegar | F25B 47/022 62/81 |
| 2014/0130536 | A1* | 5/2014 | Joppolo | F25B 7/00 62/335 |
| 2016/0290730 | A1* | 10/2016 | Taras | F28F 1/126 |
| 2019/0049194 | A1 | 2/2019 | Yanik et al. | |
| 2020/0191501 | A1 | 6/2020 | Pelletier et al. | |
| 2022/0221226 | A1 | 7/2022 | Runk et al. | |
| 2022/0243989 | A1 | 8/2022 | Zhong et al. | |
| 2024/0399822 | A1* | 12/2024 | Douda | F25B 41/20 |

FOREIGN PATENT DOCUMENTS

| | | |
|---|---|---|
| CN | 103644685 A | 3/2014 |
| CN | 105003982 | 10/2015 |
| CN | 107218822 | 9/2017 |
| CN | 109595951 | 4/2019 |
| CN | 111322795 | 6/2020 |
| DE | 102012003526 | 8/2013 |
| EP | 1762808 | 3/2007 |
| EP | 1856500 | 11/2007 |
| EP | 3798535 | 3/2021 |
| FR | 2899959 | 10/2007 |
| WO | 2004/074756 | 9/2004 |
| WO | 2006/083511 | 8/2006 |
| WO | 2012/112802 | 8/2012 |
| WO | 2020/259671 | 12/2020 |
| WO | 2021/250738 | 12/2021 |

OTHER PUBLICATIONS

EP EPO Search Report for EP 230201069.2 dated Mar. 19, 2025.

EP EPO Search Report for EP 23030/2421069.2 dated Mar. 19, 2025.

Response to Examination report EP 230201069.2 dated Jul. 31, 2025.

* cited by examiner

SYSTEM FOR CONTROLLING A DEFROST OF A DUAL FLOW HEAT EXCHANGER

BACKGROUND OF THE INVENTION

This application relates to heat exchangers that are used to cool an environment or an object that is disposed proximate to the heat exchanger as well as for heat exchangers used in heat pump systems to provide heat to an indoor space. When the heat exchanger operates in an environment that is already cool and at temperatures near or below the freezing temperature, the heat exchange surfaces have a tendency to receive a frost or ice layer thereon, which reduces the performance of the heat exchanger. The subject disclosure is related to systems to remove the frost or ice layer when needed.

SUMMARY OF THE INVENTION

A first representative embodiment of the disclosure is provided. The embodiment includes a method for controlling the performance of a refrigeration system or a heat pump system. The method includes operating a first heat exchanger in an first space, and operating a second heat exchanger in a second space, first heat exchanger is operated to remove heat from one or both of a space where the first heat exchanger is disposed or a component within the space where the first heat exchanger is disposed. The first heat exchanger comprises a first set of tubes that are arranged in a parallel flow manner between a first manifold and a second manifold, wherein straight portions of adjacent tubes within the first set of tubes are disposed with a space therebetween along each tube of the first set of tube between the first and second manifolds, and a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes. The second heat exchanger comprises first and second manifolds that are fluidly connected with both of the first set of tubes and the second set of tubes. In situations where a build-up of frost occurs upon one or more surfaces of the first heat exchanger during operation, continuing to operate the first heat exchanger to transfer heat from the refrigerant to a first medium thereby performing a defrost function upon the one or more surfaces of first heat exchanger.

The first representative embodiment wherein the first heat exchanger is in an indoor space and the second heat exchanger is in an outdoor space, wherein the method operates to remove heat from the indoor space or from a component within the indoor space that is proximate to the first heat exchanger.

The first representative embodiment wherein the first heat exchanger is in an outdoor space and the second heat exchanger is in an indoor space, wherein the method operates to provide heat from the second heat exchanger to the indoor space.

A second representative embodiment of the disclosure is provided. The embodiment includes a system for transferring heat with respect to an indoor space. The system includes a first heat exchanger that is disposed within a first space and a second heat exchanger is disposed within a second space. The first heat exchanger includes a first set of tubes that are arranged in a parallel flow manner between a first manifold and a second manifold, wherein straight portions of adjacent tubes within the first set of tubes are disposed with a space therebetween along each tube of the first set of tube between the first and second manifolds, and a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes. The second heat exchanger comprises first and second manifolds that are disposed at opposite ends of one or more flowpaths that are fluidly connected with both of the first set of tubes and the second set of tubes. The first heat exchanger is operated is operated to remove heat from one or both of the first space or a component within the first space. In situations where a build-up of frost occurs upon one or more surfaces of the first heat exchanger during operation, the system is configured to continue operation of the first heat exchanger to remove heat from the first space while performing a defrost function upon the one or more surfaces of the first heat exchanger.

The second representative embodiment, wherein the first space is an indoor space and the second space is an outdoor space.

The second representative embodiment, wherein the first space is an outdoor space and the second space is an indoor space, wherein the system operates as a heat pump to transfer heat from the outdoor space to the indoor space.

Other representative embodiments are provided that are of the scope of the Numbered Paragraphs of the specification below.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

DETAILED DESCRIPTION OF THE INVENTION

Turning now to FIGS. 1-4, a heat exchange system 10 is provided. The heat exchange system 10 includes a first heat exchanger 50 and a second heat exchanger 200. In a preferred embodiment where the system operates to provide cooling to an indoor space, the first heat exchanger 50 is disposed within an indoor space and is operated to remove heat from the indoor space, or a component within the indoor space, such that the temperature of the indoor space or a component within the indoor space remains at a cold temperature, i.e. a temperature that is below the temperature that would be maintained based upon the environment within and surrounding the indoor space without the operation of the first heat exchanger 50. The second heat exchanger 200 is provided to remove heat from the refrigerant that flows through the system such that the refrigerant that flows into the first heat exchanger can remove heat. In some embodiments, the second heat exchanger 200 is provided within an outdoor space, although the second heat exchanger 200 may alternatively be provided within an indoor space.

Figure 4:
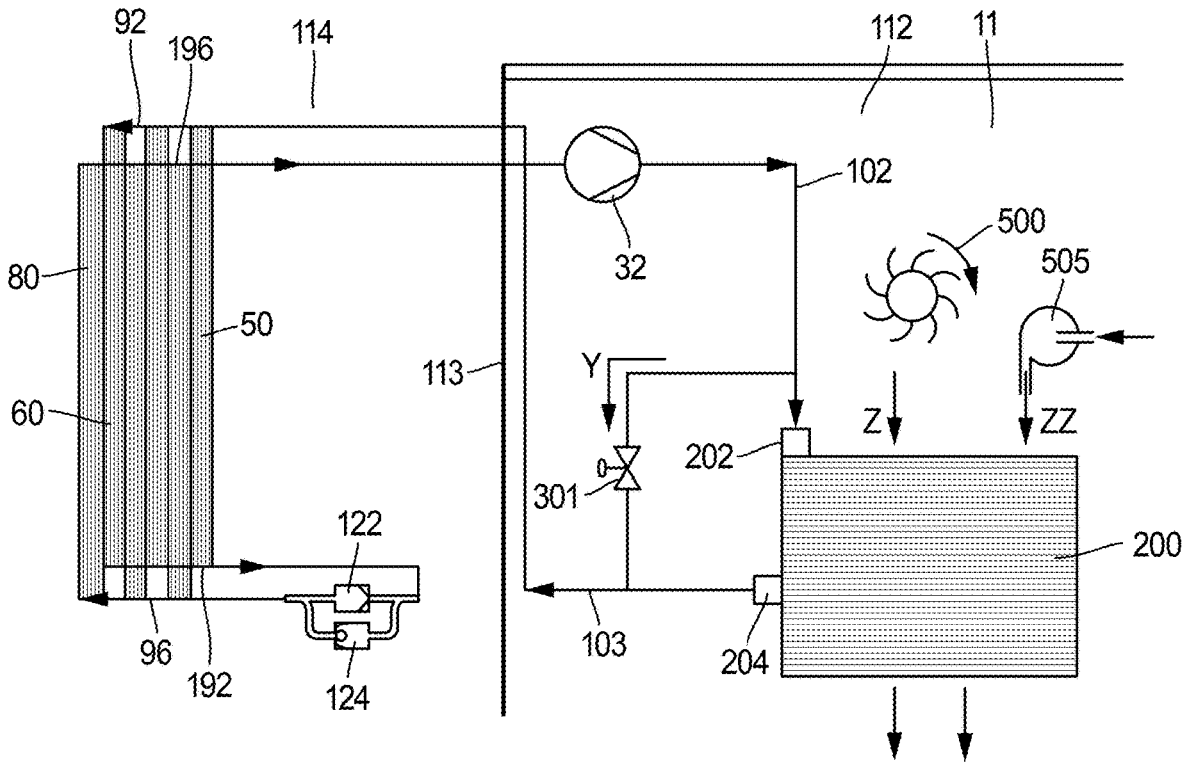
FIG. 4 is a schematic view of a system for transferring heat from an outdoor environment to an indoor environment as a heat pump.

As depicted in FIG. 4, the system 10 may operate has a heat pump where heat from an outdoor space 114 is transferred into the refrigerant and that refrigerant flows into an indoor space 112 where the heat is withdrawn from the refrigerant and flows into the indoor space therefore adding heat to the indoor space 112. The system 10 in accordance with this disclosure can be configured to operate in either settings (i.e. to provide cooling (heat removal from) to the indoor space or as a heat pump to provide heat to the indoor space 112, and when necessary the operation of the system can be modified to defrost the surfaces of the first heat exchanger 50 (discussed below) that tend to form frost thereon when the first heat exchanger 50 is operated in an environment that is close to or below freezing temperature.

Figure 1:
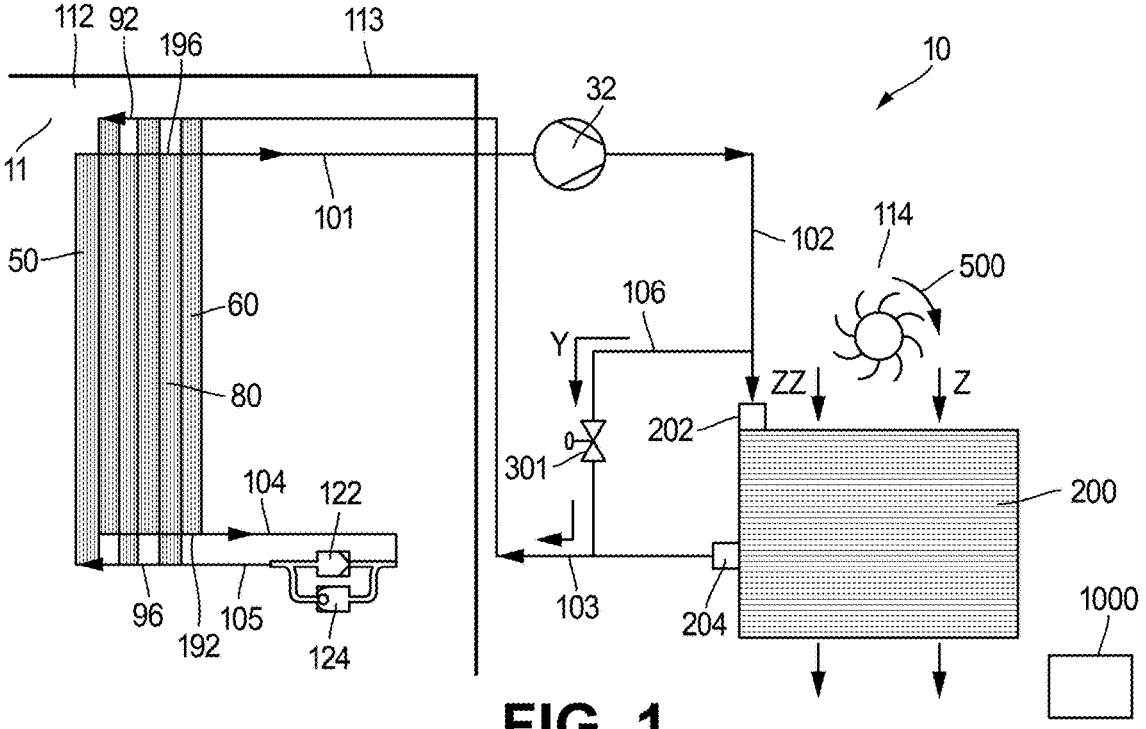
FIG. 1 is a schematic flow diagram of a system for removing heating from a space or a component.
Figure 2:
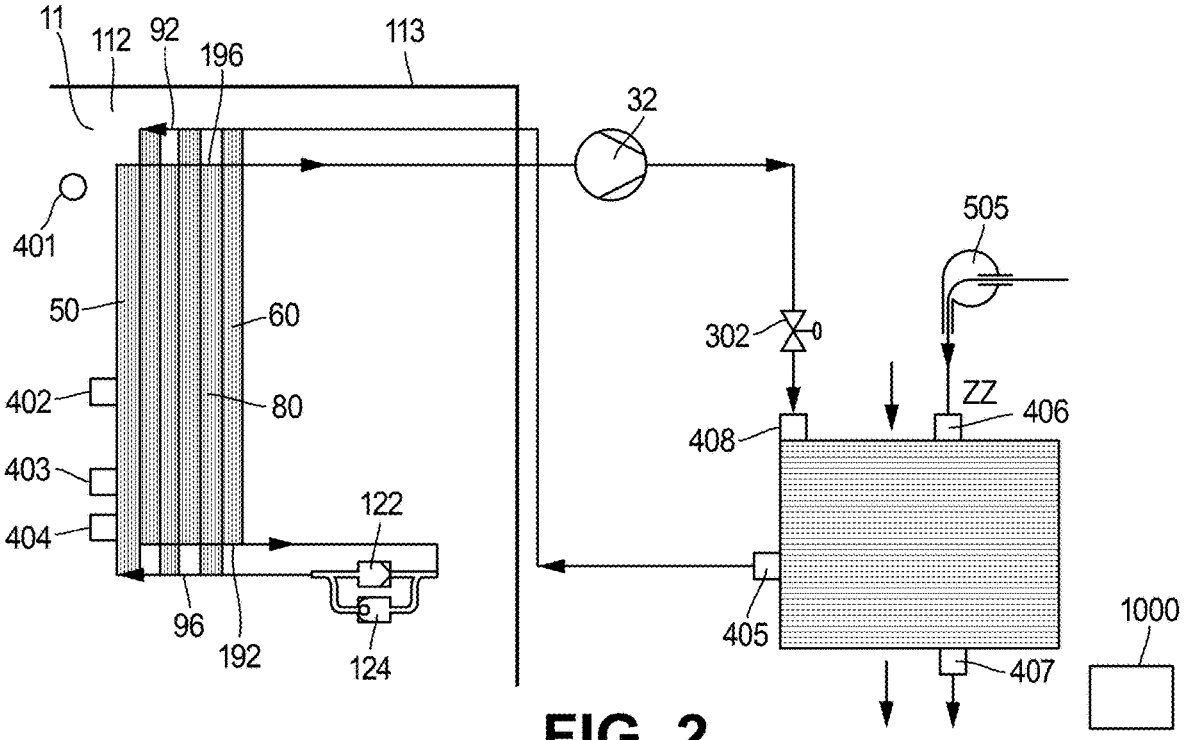
FIG. 2 is a schematic view of another system for removing heat from a space or a component.

In the embodiments depicted in FIGS. 1 and 2 the system 10 is arranged to provide cooling to the environment that surrounds the first heat exchanger 50 or to a component that is proximate to the first heat exchanger. In this embodiment, the flow path through the system 10 may be as follows. Refrigerant flows through the first heat exchanger 50 (as discussed below), and during normal operation, heat from within the environment 11 where the first heat exchanger 50 is disposed is transferred to the refrigerant flowing within the first heat exchanger—to tend to reduce the temperature within the environment 11. The first heat exchanger 50 may therefore act to lower the temperature within the environment such as to refrigerate the environment 11 or such that the environment acts as a freezer. Alternatively or additionally, specific objects that are disposed proximate to the first heat exchanger 50 may be refrigerated or frozen due to heat therefrom transferring to the refrigerant flowing through the first heat exchanger 50. In some embodiments, the first heat exchanger 50 is disposed within an indoor environment 112, with a wall 113 disposed to separate the indoor environment from an outside environment 114, or another indoor environment that is not temperature controlled.

Refrigerant that leaves the first heat exchanger 50 flows to a compressor 32 (flow path 101) where work is performed upon the refrigerant and the pressure within the refrigerant is increased. Refrigerant then flows to the second heat exchanger 200 (via flow path 102). Within the second heat exchanger 200 the refrigerant transfers heat therefrom and to a heat sink gas Z or liquid ZZ that flows across or with respect to the second heat exchanger 200 as discussed herein. This lowers the temperature of the refrigerant that leaves the second heat exchanger via the outlet manifold 204. As discussed below, in in the typical operation of the system (i.e. to remove heat from the indoor space 112, or from an object proximate to the first heat exchanger 50) the refrigerant is condensed within the second heat exchanger 200 and normally leaves the second heat exchanger 200 as a liquid or as a subcooled liquid. As discussed herein, during a defrost cycle, the refrigerant may leave the second heat exchanger 200 with a quality greater than zero. Refrigerant then flows to the first heat exchanger 50 and specifically to the first manifold 92 of the first set of tubes 60 (via flow path 103). Refrigerant flows through the first set of tubes 60, which acts as a subcooler by lowering the temperature below the refrigerant's saturation temperature, and out the second manifold 192. Refrigerant then flows to the expansion valve 122 (flow path 104) where the refrigerant is expanded thereby reducing the pressure of the refrigerant, where the refrigerant is part liquid part vapor with a reduced temperature. Refrigerant then flows to the third manifold 96 and the second set of tubes 80 (flow path 105) where the refrigerant fully evaporates by receiving heat (from the environment to be cooled—and some heat from the refrigerant flowing through the first set of tubes 60). Refrigerant flows through the second set to tubes 80 and then leaves the fourth manifold 196 to complete the cycle.

In this set up, the temperature of the refrigerant entering the first set of tubes 60 is either subcooled liquid, or in situations where the defrost cycle is occurring the refrigerant enters the first set of tubes 60 with a quality above zero. The second set of tubes 80 acts as evaporator, where the refrigerant is colder than the environment thereby drawing heat from the environment.

In other embodiments as depicted in FIG. 4, the system 10 may be operated as a heat pump to transfer heat from an outdoor environment 114 to an indoor environment 112 to provide heating thereto, or to provide heat to a component within the indoor environment 112 proximate to the second heat exchanger 200, or in other embodiments, to provide heat to a fluid (not shown) that flows past the second heat exchanger 200. In the embodiment, the first heat exchanger 50 is disposed within an outdoor environment, and the second heat exchanger 200 is disposed within an indoor environment 112 that is desired to receive heat. The heat pump system may be operated to remove heat from the outdoor environment, and can work even as the outdoor environment is at cold temperatures, i.e. on the order of 30 degrees Fahrenheit or even lower temperatures. As can be understood, when the outdoor environment is at cold temperatures that are just above, at, or below the freezing temperature of water, frost and ice may tend to form upon the surfaces of the first heat exchanger 50 during operation, which can prevent proper and efficient operation because the frost/ice reduces the ability of heat from the air surrounding the first heat exchanger 50 to transfer to the refrigerant flowing through the first heat exchanger 50. The system is operated in a defrost mode to transfer heat from the refrigerant flowing through the first heat exchanger 50 to the outer surfaces of the heat exchanger 50 to melt the frost/ice that forms thereon.

In the embodiment of FIG. 4 where the system acts as heat pump to provide heat to the indoor environment 112, the flow path of refrigerant is as follows. Refrigerant that leaves the first heat exchanger 50 flows to a compressor 32 (flow path 101) where work is performed upon the refrigerant and the pressure within the refrigerant is increased. The compressor 32 is depicted in FIG. 4 as being within the indoor space 32 but it alternatively could be provided within the outdoor space 114. Refrigerant then flows to the second heat exchanger 200 (via flow path 102). Within the second heat exchanger 200 the refrigerant transfers heat therefrom and to a heat sink gas Z or liquid ZZ that flows across or with respect to the second heat exchanger 200 as discussed herein, which adds heat to the indoor space 112 or to the liquid ZZ that passes across the second heat exchanger 200 (such as via a cross-flow heat exchanger as is known in the art). This lowers the temperature of the refrigerant that leaves the second heat exchanger via the outlet manifold 204. As discussed below, in in the typical operation of the system the refrigerant leaves the second heat exchanger 200 (which acts as a condenser) as a liquid or as a subcooled liquid. As discussed herein, during a defrost cycle, the condensing function may be reduced and the refrigerant may leave the second heat exchanger 200 with a quality greater than zero. Refrigerant then flows to the first heat exchanger 50 and specifically to the first manifold 92 of the first set of tubes 60 (via flow path 103). Refrigerant flows through the first set of tubes 60, which acts as a subcooler by lowering the temperature below the refrigerant's saturation temperature, and out the second manifold 192. Refrigerant then flows to the expansion valve 122 (flow path 104) where the refrigerant is expanded thereby reducing the pressure of the refrigerant, where the refrigerant is part liquid part vapor with a reduced temperature. Refrigerant then flows to the third manifold 96 and the second set of tubes 80 (flow path 105) where the refrigerant fully evaporates by receiving heat (from the environment- and some heat from the refrigerant flowing through the first set of tubes 60). Refrigerant flows through the second set to tubes 80 and then leaves the fourth manifold 196 to complete the cycle.

In this set up, the temperature of the refrigerant entering the first set of tubes 60 is either subcooled liquid, or in situations where the defrost cycle is occurring the refrigerant enters the first set of tubes 60 with a quality above zero. The second set of tubes 80 acts as evaporator, where the refrigerant is colder than the environment thereby drawing heat from the environment.

Figure 3:
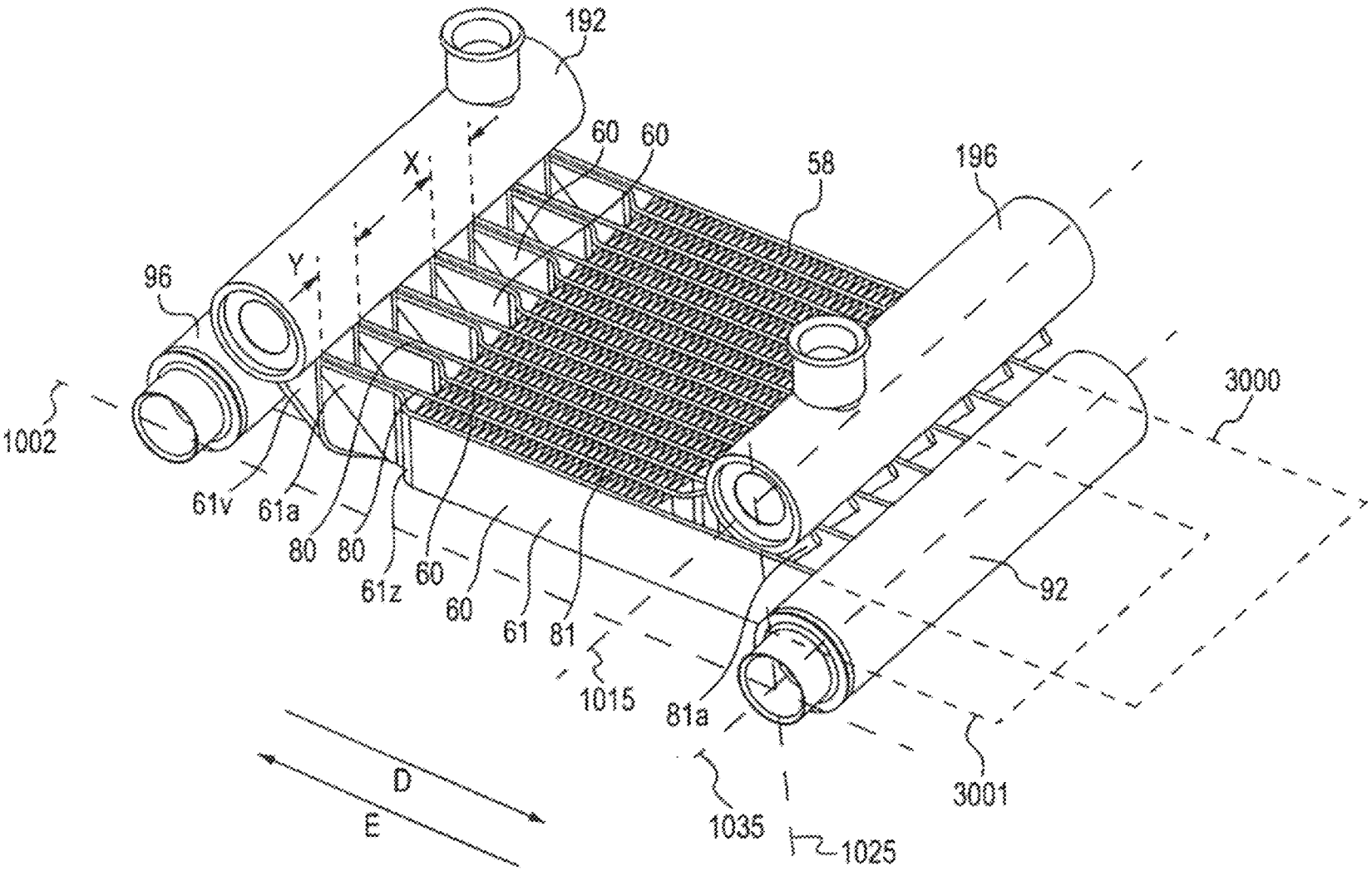
FIG. 3 is a perspective view of first heat exchanger that is used within the system of FIG. 1 or FIG. 2.

The first heat exchanger 50 that can be used with in the various embodiments provided herein is best shown in FIG. 3. The first heat exchanger 50 includes a plurality of first tubes 60 and a plurality of second tubes 80. The plurality of first tubes 60 and the plurality of second tubes 80 are fluidly disposed such that as refrigerant fluid flows through the system 10, the refrigerant flows through each of the plurality of first tubes 60 and the plurality of second tubes 80 before flowing through a second heat exchanger 200. In the embodiments provided herein the first heat exchanger 50 is disposed to remove heat from the space that the first heat exchanger 50 is disposed herein, or to remove heat from a component that is proximate (or in fluid communication with a fluid flow flows past the first heat exchanger 50) to remove heat from the component.

The plurality of first tubes 60 extend in the same direction and are disposed in a parallel and offset manner with respect to each other to extend from a first manifold 92 to a second manifold 192. The first tubes 60 are positioned with respect to each other such that the adjacent tubes within the first set of tubes establishes a space X therebetween along each tube between the first manifold 92 and the second manifold 192. Other aspects of the plurality of first tubes from each embodiment will be discussed in detail below.

The plurality of second tubes 80 all extend in the same direction and are disposed in a parallel and offset manner with respect to each other to extend from a third manifold 96 to a fourth manifold 196. The second tubes 80 are positioned with respect to each other such that the adjacent tubes within the second set of tubes establishes a space Y therebetween along each tube between the third manifold 96 and the fourth manifold 98. A central portion 81 (also referred to as the heat exchange portion) of each of the second tubes 80 are disposed within the space X between adjacent central portions 61 (heat exchange portions) of adjacent first tubes 60. Wherein "each" tube as used herein with respect to both the first set of tubes 60 and the second set of tubes 80 is specifically defined herein to mean all of the respective tubes with the possible exception of the tube(s) 60 and/or tube(s) 80 that is the most outboard of the plurality of tubes, and establishes an outer tube within the heat exchange assembly. One of ordinary skill in the art will understand that for the two tubes that establish the outer tube within the heat exchange assembly, there will be no tubes that extend adjacent to that tube on the outer side of that tube and therefore the central portion of the outer tubes do not extend within a space between adjacent tubes of the other set of tubes. The term "each" includes all tubes that extend between two tubes of the opposite sets of tubes, and to include the two tubes that establish the outer-most tube of the heating assembly, which are adjacent to the central portion of a tube from the other set of tubes.

The heat exchanger 50 is aligned within a HVAC system, a heating system, or a cooling system as discussed herein. The heat exchanger 50 allows for two flows of fluid, a first flow simultaneously through the plurality of first tubes 60 and a second flow simultaneously though the plurality of second tubes 80. The heat exchanger 50 may be plumbed with respect to the HVAC, a heating system, or cooling system in various different scenarios, as discussed herein, so that flow through both the first and second sets of tubes are each in the general direction D, both in the general direction E or that a flow through the plurality of first tubes 60 is in the direction D and the flow through the plurality of second tubes is in the direction E. The heat exchanger 50 may be used with a forced air or fluid flow across the tubes and the fins 58 that are connected to the tubes or with other heat transfer methods as known in the art. In some embodiments, each of the plurality of first tubes 60 and the plurality of second tubes 80 may support a plurality of fins that extend outward therefrom. The fins 58 that extend from the plurality of first tubes 60 may contact a surface of an adjacent tube from the second plurality of tubes 80 and the fins that extend from the second plurality of tubes 80 may contact a surface of an adjacent tube from the first plurality of tubes 60. Alternatively, some fins 58 may be connected adjacent tubes from the first and second pluralities 60, 80. In still other embodiments, fins 58 that extend from tubes of the first plurality 60 may connect to tubes 58 that extend from the second plurality of tubes 80, with connections configured to enhance heat flow through the connections through welding or via other methods known in the art.

The tubes 60 and 80 may be formed with different geometries and different cross-sections. In some embodiments, the tubes 60 and 80 are made to be mirror images of each other, such that, for example, a bent portion of tube 60 begins bending in a direction with a left vector component and has a later portion of the tube that bends with a right vector component, while the bent portion of the tube 80 begins bending in a direction with a right vector component and a later portion of the tube that bends with a left vector component. Other than the opposite bending directions of the first and second tubes, the tubes are the same—with the extended end portions extending in the same direction (i.e. an upper vector component) for both tubes, and the curvature of the bending portions of each of the first and second tubes being substantially mirror images of each other with a mirror plane vertical and through the longitudinal axis of the straight central portion of each tube (i.e. parallel to the wide surfaces of the straight portion of each tube). In some embodiments, the tubes are formed with outer walls that establish a single lumen, while tubes may alternatively be formed with a plurality of separate parallel flow lumens. The term substantially includes exactly the same as well as minor differences in bending the tubes due to reasonable tolerances that are typical in the art of bending long tubes-such as tolerances of up to plus or minus 5 degrees of tolerance of a bending angle (on either side of the nominal bending angle), up to plus or minus of several millimeters of difference in radial length or arc length on curvatures from the nominal, and up to plus or minus several millimeters of differences in bends begin or end from a nominal position where a bend is designed to begin or end upon the length of each tube.

The tubes 60, 80 are preferably made from metal, although other materials that have high thermal conductivity. The tubes may be constructed from a uniform material along the entire cross-section and length of the tube, while in other embodiments, the tube could be constructed from several layers, such as an inner layer of more flexible material (with a relatively high thermal conductivity) but that is flexible enough to be bent into the desired shape of the transition region 61*a*, 81 as discussed below without resulting in crimping or significantly blocking the lumens x, while another material provided outboard with a higher thermal conductivity and potentially with other benefits (weight, cost benefits over the inner flexible material). The tubes 60, 80 may be constructed by extrusion, or machining, or by bending planar pieces into shape to form the desired cross-sectional geometry and then bent in the geometry and shape along the length of the tubes.

The second heat exchanger 200 is depicted schematically in FIGS. 1, 2, and 4. The second heat exchanger may be any type of heat exchanger known in the art to allow for a refrigerant to pass therethrough and transfer heat with either the environment (due to flow Z past the heat exchanger-which may be air flow Z as urged by a fan 500 (FIG. 1, schematic) or may be liquid flow ZZ past (FIG. 2, schematic) the heat exchanger 200.

The second heat exchanger 200 may include inlet and outlet manifolds 202, 204 (schematic) that respectively receive refrigerant flow into the heat exchanger and allow for flow to leave the heat exchanger. The second heat exchanger 200 may include a plurality of tubes that run between the inlet and outlet manifolds 202, 204 to maximize the surface area for heat transfer between the tubes and the fluid that passes therepast (Z, ZZ). The plurality of tubes may be parallel to each along their entire length or a portion of their length. The plurality of tubes may each be the same length, or in other embodiments, the tubes may be of different lengths-dependent upon the placement of the respective tube within the heat exchanger and in relationship with the heat transfer fluid that flows therepast. For example, tubes interact with the heat transfer fluid when it initially contacts the heat exchanger (thereby typically with the largest temperature differential between the refrigerant and the heat transfer fluid) may shorter (less length for flow within the heat exchanger) than tubes that do not initially interact with the heat transfer fluid until it has already flowed past the initial tubes (thereby typically with lower temperature differential) with the differing lengths positioned in order to make the total heat transfer through each tube as even as possible throughout each tube within the heat exchanger. This design may allow the temperature and state (i.e. quality) of the refrigerant that leaves each tube through the outlet manifold 204 to be as uniform as possible. The second heat exchanger 200 may be a dual flow heat exchanger, with the refrigerant flowing through the heat exchanger via one path, and the fluid Z, ZZ flowing through the heat exchanger as well-either through dedicated tube(s) within the heat exchanger, or through other flow paths.

In another embodiment, the second heat exchanger 200 may include an internal volume that the refrigerant flows into, and may include tubes that extend through the internal volume. The refrigerant flows into the internal volume through the inlet manifold 202 and out of the internal volume through the outlet manifold 204. The tubes through the internal volume allow flow of the heat transfer air flow Z or liquid flow ZZ to flow through the internal volume and receive heat from the refrigerant within the internal volume. As discussed above, the tubes for the heat transfer air/liquid may be designed to make the refrigerant temperature within the internal volume as uniform as possible. In still other embodiments, the refrigerant may flow through tubes within the second heat exchanger, and the heat transfer air or liquid Z, ZZ may also flow through tubes.

The flow Z, ZZ past the heat exchanger 200 may be natural circulation or in other embodiments, the flow Z, ZZ may be forced flow such as urged by a fan 500 (schematic FIG. 1) or a pump 505 (schematic FIG. 2). The flow Z, ZZ of the air or liquid past the tubes of the second heat exchanger. As discussed herein, the mass flow rate of the flow Z, ZZ may be modified (per the direct or indirect instructions from a controller 1000 discussed herein) by modifying the fan 500 speed or the pump 505 speed. Modifying the flow rate of the flow Z, ZZ will modify the amount of heat from the refrigerant that is removed as the flow Z, ZZ moves through/across the tubes, which modifies the outlet temperature and quality of the refrigerant leaving through the outlet manifold 204.

As discussed herein, in one embodiment the controller 1000 may directly control or indirectly control the fan 500 or pump 505 (schematic in FIGS. 1, 2, and 4) to modify the flow rate Z, ZZ of past the second heat exchanger 200 to reduce the amount of heat removed from the refrigerant that flows through the second heat exchanger 200, which modifies the state of the refrigerant that leaves the second heat exchanger via the outlet manifold 204. The change in flow rate past second heat exchanger 200 may occur when the system acts to refrigerate/cool the environment (FIGS. 1, 2) and when the system is arranged as a heat pump to add heat to the environment (FIG. 4). This modification changes the temperature and state of the refrigerant that reaches the first set of tubes 60. For example, reducing the amount of heat that is removed from the refrigerant that flows through the second heat exchanger 200 causes the temperature of the refrigerant that enters the first set of tubes 60 to increase, and in some embodiments causes the refrigerant to have a quality above zero as it flows through the outlet manifold 204 and flows to the first heat exchanger 50. In this state, the increasing a temperature differential between the refrigerant and the environment surrounding the tubes, and the temperature differential between the refrigerant in the first and second sets of tubes 60, 80 increases, which causes heat to transfer from the first set of tube 60 to the refrigerant flowing through the second set of tubes 80, as well as heat transferring through the first tubes 60 to the environment, which will further condense to approach or reach a quality of zero. This increased temperature differential (temperature increase of refrigerant entering the first set of tubes 60 through the first manifold 92) can melt any ice/frost that has formed upon the surface of the first set of tubes 60. Similarly the larger temperature differential between the refrigerant in the first set of tubes and the second set of tubes 60/80 increases causes an increase in heat flow toward the second set of tubes 80—and therefore the additional heat tends to melt any ice/frost that as formed on the surface of the second set of tubes 80.

The computing elements or functions disclosed, including the controller 1000 herein may include a processor and a memory storing computer-readable instructions executable by the processor. In some embodiments, the processor is a hardware processor configured to perform a predefined set of basic operations in response to receiving a corresponding basic instruction selected from a predefined native instruction set of codes. Each of the modules defined herein may include a corresponding set of machine codes selected from the native instruction set, and which may be stored in the memory. Embodiments can be implemented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, optical disc, memory device (volatile or non-volatile), or similar storage mechanism. The machine-readable medium can contain various sets of instructions, code sequences, configuration information, or other data, which, when executed, cause a processor to perform steps in a method according to an embodiment of the invention. Those of ordinary skill in the art will appreciate that other instructions and operations necessary to implement the described embodiments can also be stored on the machine-readable medium. Software running from the machine-readable medium can interface with circuitry to perform the described tasks. Moreover, embodiments may be implemented on application specific integrated circuits (ASICs) or very large scale integrated (VLSI) circuits. In fact, persons of ordinary skill in the art may utilize any number of suitable structures capable of executing logical operations according to the embodiments.

The first heat exchanger 50 provides flow to an expansion valve 122. In some embodiments, the expansion valve 122 is positioned between the first set of tubes 60 (specifically the second manifold 192) and the second set of tubes 80 (specifically the third manifold 96). Specifically refrigerant that flows through the first set of tubes 60 flows to the expansion valve 122 and then flows to the second set of tubes 80. In some embodiments, a check valve 124 is provided across the expansion valve, arranged such that the check valve 124 is closed in the normal direction of flow (i.e. first set of tubes 60, to the expansion valve 122, to the second set of tubes 80), but would allow flow in the opposite direction (i.e. second set of tubes 80 through the third manifold through the check valve 124 and then to the first set of tubes 60 through the second manifold 192).

The expansion valve 122 is provided to reduce the pressure of the refrigerant that flows through the expansion valve as is well known within a refrigeration cycle, such that the quality of the refrigerant leaving the expansion valve 122 is a quality greater than zero but less than 1. The second set of tubes 80 receives this refrigerant and the receipt of heat into the refrigerant within the second set of tubes 80 causes the refrigerant to evaporate therewith—further removing heat from the environment around the second set of tubes 80.

In some embodiments, the system 10 may be monitored to determine whether a defrost cycle is needed—due to a directly determined amount of ice or frost upon the surfaces of the first heat exchanger 50 or by measuring various thermodynamic conditions associated with the system that typically result in ice or frost formation.

FIG. 2 schematically depicts several sensors where one or more may be provided and sending signals to the controller 1000, where the controller receives signals from one or more sensors and determines whether an ice or frost layer has formed—or whether the conditions associated with the formation of ice or frost are occurring. For example, a photoelectric sensor 401 may be provided that visually monitors one or more surfaces of the first heat exchanger 50 (such as one or both of tubes within the first or second sets of tubes 60, 80, and or fins 58 that extend from and between the tubes). The photoelectric sensor 401 may be any sensor known in the art that can visually monitor for the formation of ice upon a surface, or the presence of water upon the surface (in combination with the temperature of the surface being monitored).

Alternatively, or additionally, an ice sensor 402 may be provided upon one or more surfaces of the first heat exchanger 50, with the ice sensor 402 being capable of identification of ice formed thereon.

Alternatively or additionally, a temperature sensor 403 may be provided upon or proximate to one or more surfaces of the first heat exchanger 50, preferably in combination with a humidity sensor 404, and in some embodiments in combination with an air pressure sensor 405 that is/are mounted upon or proximate to the one or more surfaces of the first heat exchanger 50. As is known in the art, the humidity within the air in combination with a measurement of the temperature (and air pressure when provided) will assist in determining whether ice will form upon surfaces of the first heat exchanger 50 and a continued monitoring during an elongate time in conditions favorable for formation of ice will allow the controller 1000 to determine that ice has likely formed upon the surfaces of the first heat exchanger 50. The controller 1000 with this indirect measurement of ice formation can be programmed to determine when it is likely that sufficient ice/frost has formed upon the heat transfer surfaces of the first heat exchanger 50 that a defrost cycle is needed to remove all or a portion of the ice/frost formed for more efficient future operation of the first heat exchanger 50 to cool the space or cause cooling of the object(s) proximate to the first heat exchanger 50.

In some embodiments, a need for a defrost cycle may be determined by the controller 1000 based upon other inputs. For example, the controller 1000 may monitor the power used by the compressor and determine that a defrost cycle is needed if the power increases above a certain threshold (due the refrigerant not fully evaporating within the second set of tubes 80 due to insufficient receipt of heat therein due to the ice/frost upon surfaces thereof preventing sufficient heat transfer to the refrigerant flowing through the second set of tubes 80). Similarly, the controller 1000 may identify that a defrost cycle is needed due to an identification of a decreased inlet refrigerant temperature (sensor 408) that indicates that the refrigerant flowing through the second set of tubes 80 is not receiving as much heat is expected—potentially due to surface fowling by ice/frost upon the heat transfer surfaces of the first heat exchanger 50. Other determinations may be provided—such as a manual selection to defrost by a user, or a program where the controller 1000 initiates a defrost cycle a periodic time basis during operations of the system 10—with the periodic times varying due to measured temperatures within the environment where the first heat exchanger 50 operates.

Upon determining that a defrost function (or cycle) is needed (or desired by a user, or called for such as due to reaching a time when a periodic or scheduled defrost should occur) the controller 1000 may operate the system using one or more steps as discussed below. The controller 1000 may operate the defrost function until the directly observed ice/frost is melted, or in embodiments where the ice/frost is indirectly observed, the controller 1000 may operate the defrost function for a time duration that it has been programmed to determine is sufficient for removal of the ice/frost from the first heat exchanger 50. Alternatively, the controller 1000 may operate the defrost function for a set period of time that is determined to be sufficient for defrosting the first heat exchanger 50 (which may vary with different environmental temperatures and differing humidities within the environment where the first heat exchanger 50 operates).

In one embodiment, upon determining that a defrost function is initiated by reducing a condensing function of the second heat exchanger 200. The reducing a condensing function of the second heat exchanger 200 may be performed by reducing a flow of a heat exchange gas (such as air) or a liquid that flows into contact or through the second heat exchanger 200. In embodiments where the second heat exchanger 200 receives a flow of forced air Z thereacross (or through, as discussed above) the mass flow rate of air across the second heat exchanger 200 may be caused by the controller 1000 to be reduced, such as by slowing down the feed of the fan 500, or by constraining the amount of air that can flow into the suction of the fan 500. In other embodiments, where liquid flows ZZ past or through the second heat exchanger, the pump 505 speed may be decreased, or the inlet flow into the suction of the pump 505 may be decreased. The decrease of flow past or into the second heat exchanger 200 lowers capacity of the second heat exchanger 200 to remove heat from the refrigerant that flows through the second heat exchanger 200, such that the refrigerant leaving the outlet manifold 204 may have a quality above 0 or may be at a higher temperature than with normal operations if fully condensed to liquid.

In other embodiments, (or potentially in addition to the reduction of the cooling flow Z or ZZ as discussed herein), a bypass line 106 that short circuits the second heat exchanger 200 may be opened—either fully opened or partially opened with a throttle valve—to allow some refrigerant flow to bypass the second heat exchanger 200 and not receive the cooling provided by the flow Z or ZZ as discussed above. This bypass flow (which is heated vapor from the compressor 32) combines with the flow out of the outlet manifold 204 (which may be fully condensed liquid or potentially refrigerant with a quality greater than zero) and flows toward the first heat exchanger 50.

In other embodiments (or potentially in addition to one or more of the embodiments herein) a throttle valve 302 (FIG. 2) may be provided between the outlet of the compressor 32 and the inlet manifold 202 of the second heat exchanger 200. The throttle valve may be in a first position for normal operations and a second further open position for the defrost function. Further opening the throttle valve 302 increases the flow of refrigerant into the second heat exchanger 200. With an increased flow—with the same amount of flow of air Z or liquid ZZ across or through the heat exchanger 200 the amount of heat removed per given volume of flow is decreased.

In still other embodiments especially applicable for the embodiments of FIGS. 1 and 2 where the system 10 is operated to cool the environment where the first heat exchanger 50 is located, (or potentially in addition to one or more of the embodiments herein) the temperature of the air Z or liquid ZZ across or through the heat exchanger 200 may be increased—which reduces the differential temperature across the heat exchanger 200 and therefore decreases the heat flow from the refrigerant to the air Z or liquid ZZ.

In still other embodiments, therethrough (or potentially in addition to one or more of the embodiments herein) the position of the expansion valve 122 may be modified to open the expansion valve—therefore allowing a larger mass flow rate of refrigerant therethrough. This increases the saturation temperature of the flow that enters the second set of tubes 80 within the first heat exchanger 50, the combination of increased saturation temperature and increased flowrate (decreased subcooling) will work to defrost the heat exchanger.

Each of these possible steps (alone or in combination as directed by the controller) results in the refrigerant that flows to the first manifold 92 and into the first set of tubes 60 being at a higher temperature (and potentially with a higher quality) than during normal operations. This causes increased heat flow from the refrigerant to the heat transfer surfaces of the first heat exchanger 50, which tends to meld any frost or ice that forms upon the first heat exchanger 50. As discussed above, when the controller 1000 directly determines that the ice/frost has been melted as desired, or indirectly determines that the ice/frost should have melted as desired, the controller 1000 the system to normal operation, such as by reversing the applicable one or more steps discussed above to the normal configurations. This causes the refrigerant that reaches the first manifold 92 to be at a lower temperature or to be at a quality of zero or sometimes more subcooled, which increases the efficiency of the first heat exchanger 50 at cooling the environment where the first heat exchanger 50 is located or to provide additional cooling to the objects that are desired to be cooled that are proximate to the first heat exchanger 50.

The term "about" is specifically defined herein to include a range that includes the reference value and plus or minus 5% of the reference value. The term "substantially the same" is satisfied when the width of the end surfaces of the holes are both within the above range.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The specification can be best understood with reference to the following Numbered Paragraphs:

Numbered Paragraph 1: A method of controlling the performance of a refrigeration system, comprising:

operating a first heat exchanger, and operating a second heat exchanger, first heat exchanger is operated to remove heat from one or both of a space where the first heat exchanger is disposed or a component within the space where the first heat exchanger is disposed the first heat exchanger comprises a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

wherein the second heat exchanger comprises first and second manifolds that are fluidly connected with both of the first set of tubes and the second set of tubes;

wherein in situations where a build-up of frost occurs upon one or more surfaces of the first heat exchanger during operation, continuing to operate the first heat exchanger to transfer heat from the refrigerant to the first medium thereby performing a defrost function upon the one or more surfaces of first heat exchanger.

Numbered Paragraph 2: The method of Numbered Paragraph 1, wherein during operation the first set of tubes operate as a subcooler and the second set of tubes operate as an evaporator, wherein refrigerant flows first through the first set of tubes, then through an expansion valve and then through the second set of tubes as the refrigerant flows through the system.

Numbered Paragraph 3: The method of Numbered Paragraph 2, wherein the refrigerant flows through a compressor upon leaving the second set of tubes, and then flows through the second heat exchanger, wherein the second heat exchanger acts as a condenser.

Numbered Paragraph 4: The method of Numbered Paragraph 3, wherein the defrost function comprises reducing a capacity of the condenser to condense the high pressure refrigerant that enters the second heat exchanger thereby causing a temperature of the refrigerant that flows into the first set of tubes to increase.

Numbered Paragraph 5: The method of Numbered Paragraph 4, wherein the step of reducing the capacity of the condenser to condense the high pressure refrigerant comprises reducing a flow of air that flows past the second heat exchanger.

Numbered Paragraph 6: The method of Numbered Paragraph 4, wherein the step of reducing the capacity of the condenser to condense the high pressure refrigerant comprises allowing a portion of the refrigerant flow from the compressor to bypass the second heat exchanger and flow to the first set of tubes of the first heat exchanger without flowing through the condenser.

Numbered Paragraph 7: The method of Numbered Paragraph 4, wherein the step of reducing the capacity of the condenser to condense the high pressure refrigerant comprises modifying a position of a throttle valve disposed between the compressor and the condenser to increase a flow rate of refrigerant through the condenser.

Numbered Paragraph 8: The method of any one of Numbered Paragraphs 4-7, further comprising monitoring for the existence of frost upon surfaces of the first heat exchanger and upon an identification a predetermined amount of frost upon the first heat exchanger beginning to perform the defrost function.

Numbered Paragraph 9: The method of Numbered Paragraph 8, during the defrost function continuing to monitor for the existence of frost upon surfaces of the first heat exchanger and upon identification of a reduced presence or an elimination of frost upon the first heat exchanger discontinuing the defrost function by increasing the capacity of the condenser to condense the high pressure refrigerant that enters the second heat exchanger.

Numbered Paragraph 10: The method of any one of Numbered Paragraphs 4-9, wherein upon reducing the capacity of the condenser to condense high pressure refrigerant that enters the second heat exchanger, the temperature of the refrigerant that reaches the first set of tubes increases thereby allowing for additional transfer of heat through walls that form the first set of tubes and to walls that form the second set of tubes.

Numbered Paragraph 11: The method of any one of Numbered Paragraphs 1-10, further comprising the use of one or more of the following to monitor for the existence of frost upon surfaces of the first heat exchanger: a photoelectric sensor to monitor a surface of the first heat exchanger, an ice sensor to monitor the surface of the first heat exchanger, a temperature sensor to monitor the first heat exchanger, a humidity sensor, an air pressure sensor, monitoring the power of the compressor, monitoring a change in heat transfer via the condenser.

Numbered Paragraph 12: The method of any one of Numbered Paragraphs 1-11 and particularly Numbered Paragraphs 3-11, wherein the refrigerant that leaves the first set of tubes flows through an expansion valve before flowing through the second set of tubes, wherein the defrost function comprises further opening the expansion valve to allow for increased refrigerant flow therethrough.

Numbered Paragraph 13: The method of Numbered Paragraph 12, wherein the refrigerant continues to flow through the first set of tubes and then through the second set of tubes while performing the defrost function upon the first heat exchanger.

Numbered Paragraph 14: The method of any one of Numbered Paragraphs 4-10, wherein the refrigerant that leaves the first set of tubes flows through the expansion valve before flowing through the second set of tubes, wherein the defrost function comprises further opening the expansion valve to allow for increased refrigerant flow therethrough.

Numbered Paragraph 15: The method of any one of the preceding Numbered Paragraphs, wherein a first medium flows past the first set of tubes a so that heat is transferred from the refrigerant flowing through the first set of tubes to the first medium;

wherein the first medium flows past the second set of tubes so that heat is transferred to the refrigerant within the second set of tubes from the first medium.

Numbered Paragraph 16: The method of any one of the preceding Numbered Paragraphs, wherein the first heat exchanger is in an indoor space and the second heat exchanger is in an outdoor space, wherein the method operates to remove heat from the indoor space or from a component within the indoor space that is proximate to the first heat exchanger.

Numbered Paragraph 17: The method of any one of Numbered Paragraphs 1-15, wherein the first heat exchanger is in an outdoor space and the second heat exchanger is in an indoor space, wherein the method operates to provide heat from the second heat exchanger to the indoor space.

Numbered Paragraph 18: A system for transferring heat with respect to an indoor space, comprising:

a first heat exchanger that is disposed within an a first space and a second heat exchanger is disposed within a different second space, the first heat exchanger comprises:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

the second heat exchanger comprises first and second manifolds that are disposed at opposite ends of one or more flowpaths that are fluidly connected with both of the first set of tubes and the second set of tubes;

wherein the first heat exchanger is operated is operated to remove heat from one or both of the first space or a component within the first space;

wherein in situations where a build-up of frost occurs upon one or more surfaces of the first heat exchanger during operation, the system is configured to continue operation of the first heat exchanger to remove heat from the first space while performing a defrost function upon the one or more surfaces of the first heat exchanger.

Numbered Paragraph 19: The system of Numbered Paragraph 18, wherein during operation the first set of tubes operate as a subcooler and the second set of tubes operate as an evaporator, wherein refrigerant flows first through the first set of tubes, then through an expansion valve and then through the second set of tubes as the refrigerant flows through the system.

Numbered Paragraph 20: The system of Numbered Paragraph 19, wherein the refrigerant flows through a compressor upon leaving the second set of tubes, and then flows through the second heat exchanger, wherein the second heat exchanger acts as a condenser.

Numbered Paragraph 21: The system of any one of Numbered Paragraphs 18-20, wherein the defrost function comprises reducing a capacity of the condenser to condense the high pressure refrigerant that enters the second heat exchanger thereby causing a temperature of the refrigerant that flows into the first set of tubes to increase.

Numbered Paragraph 22: The system of Numbered Paragraph 21, further comprising one or more of the following to monitor for the existence of frost upon surfaces of the first heat exchanger: a photoelectric sensor configured to monitor a surface of the first heat exchanger, an ice sensor configured to monitor the surface of the first heat exchanger, a temperature sensor configured to monitor the first heat exchanger, an air pressure sensor, a sensor configured to monitor the electrical power usage of the compressor, or one or more sensors that monitor parameters of the condenser that can be used by a controller to determine an amount of heat removed from the refrigerant within the condenser.

Numbered Paragraph 23: The system of any one of Numbered Paragraphs 18-22, wherein the defrost function further comprises further opening the expansion valve to allow for increased refrigerant to flow through the expansion valve.

Numbered Paragraph 24: The system of any one of Numbered Paragraphs 18-23, wherein the first space is an indoor space and the second space is an outdoor space.

Numbered Paragraph 25: The system of any one of Numbered Paragraphs 18-23, wherein the first space is an outdoor space and the second space is an indoor space, wherein the system operates as a heat pump to transfer heat from the outdoor space to the indoor space.

The invention claimed is:

1. A method of controlling the performance of a refrigeration system, comprising:

operating a first heat exchanger, and operating a second heat exchanger, the first heat exchanger is operated to remove heat from one or both of a space where the first heat exchanger is disposed or a component within the space where the first heat exchanger is disposed, the first heat exchanger comprises a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are disposed within the space between straight portions of adjacent tubes of the first set of tubes; wherein a refrigerant that flows through the first set of tubes additionally flows through the second set of tubes before the refrigerant returns to again flow through the first set of tubes;

wherein the second heat exchanger comprises first and second manifolds that are fluidly connected with both of the first set of tubes and the second set of tubes;

wherein in situations where a build-up of frost occurs upon one or more surfaces of the first heat exchanger during operation, continuing to operate the first heat exchanger to transfer heat from the refrigerant to a first medium thereby performing a defrost function upon the one or more surfaces of first heat exchanger, and reducing a heat removal from refrigerant within the second heat exchanger to thereby increase a temperature of the refrigerant that reaches the first exchanger after leaving the second heat exchanger.

2. The method of claim 1, wherein during operation the first set of tubes operate as a subcooler and the second set of tubes operate as an evaporator, wherein refrigerant flows first through the first set of tubes, then through an expansion valve and then through the second set of tubes as the refrigerant flows through the system.

3. The method of claim 2, wherein the refrigerant flows through a compressor upon leaving the second set of tubes, and then flows through the second heat exchanger, wherein the second heat exchanger acts as a condenser.

4. The method of claim 3, wherein the step of reducing the heat removal from refrigerant within the second heat exchanger comprises reducing a flow of air that flows past the second heat exchanger.

5. The method of claim 3, wherein the step of reducing the heat removal from refrigerant within the second heat exchanger comprises allowing a portion of the refrigerant flow from the compressor to bypass the second heat exchanger and flow to the first set of tubes of the first heat exchanger without flowing through the second heat exchanger.

6. The method of claim 3, wherein the step of reducing the heat removal from refrigerant within the second heat exchanger comprises modifying a position of a throttle valve disposed between the compressor and the second heat exchanger to increase a flow rate of refrigerant through the second heat exchanger.

7. The method of claim 3, further comprising monitoring for the build-up of frost upon surfaces of the first heat exchanger and upon an identification of a predetermined amount of frost upon the first heat exchanger beginning to perform the defrost function.

8. The method of claim 7, during the defrost function continuing to monitor for the build-up of frost upon surfaces of the first heat exchanger and upon identification of a reduced presence or an elimination of frost upon the first heat exchanger discontinuing the defrost function by increasing the capacity of the condenser to condense the high pressure refrigerant that enters the second heat exchanger.

9. The method of claim 7, further comprising the use of one or more of the following to monitor for the build-up of frost upon surfaces of the first heat exchanger: a photoelectric sensor to monitor a surface of the first heat exchanger, an ice sensor to monitor the surface of the first heat exchanger, a temperature sensor to monitor the first heat exchanger, a humidity sensor, an air pressure sensor, monitoring the power of the compressor, monitoring a change in heat transfer via the condenser.

10. The method of claim 3, wherein the refrigerant that leaves the first set of tubes flows through an expansion valve before flowing through the second set of tubes, wherein the defrost function comprises further opening the expansion valve to allow for increased refrigerant flow therethrough.

11. The method of claim 10, wherein the refrigerant continues to flow through the first set of tubes and then through the second set of tubes while performing the defrost function upon the first heat exchanger.

12. The method of claim 1, wherein the first heat exchanger is in an indoor space and the second heat exchanger is in an outdoor space, wherein the method operates to remove heat from the indoor space or from a component within the indoor space that is proximate to the first heat exchanger.

13. The method of claim 1, wherein the first heat exchanger is in an outdoor space and the second heat exchanger is in an indoor space, wherein the method operates to provide heat from the second heat exchanger to the indoor space.

14. A system for transferring heat with respect to an indoor space, comprising:

a first heat exchanger that is disposed within a first space and a second heat exchanger is disposed within a different second space, the first heat exchanger comprises:

a first set of tubes that are arranged in a parallel flow manner between a first manifold and a second manifold, wherein straight portions of adjacent tubes within the first set of tubes are disposed with a space therebetween along each tube of the first set of tubes between the first and second manifolds;

a second set of tubes that are arranged in a parallel flow manner between a third manifold and a fourth manifold, wherein straight portions of adjacent tubes within the second set of tubes are disposed within the space between straight portions of adjacent tubes of the first set of tubes; wherein a refrigerant that flows through the first set of tubes additionally flows through the second set of tubes before the refrigerant returns to again flow through the first set of tubes;

the second heat exchanger comprises first and second manifolds that are disposed at opposite ends of one or more flowpaths that are fluidly connected with both of the first set of tubes and the second set of tubes;

wherein the first heat exchanger is operated is operated to remove heat from one or both of the first space or a component within the first space;

wherein in situations where a build-up of frost occurs upon one or more surfaces of the first heat exchanger during operation, the system is configured to continue operation of the first heat exchanger to remove heat from the first space while performing a defrost function upon the one or more surfaces of the first heat exchanger, and the system is further configured to reduce a heat removal from refrigerant within the second heat exchanger to thereby increase a temperature of the refrigerant that reaches the first heat exchanger after leaving the second heat exchanger.

15. The system of claim 14, wherein during operation the first set of tubes operate as a subcooler and the second set of tubes operate as an evaporator, wherein refrigerant flows first through the first set of tubes, then through an expansion valve and then through the second set of tubes as the refrigerant flows through the system.

16. The system of claim 15, wherein the refrigerant flows through a compressor upon leaving the second set of tubes, and then flows through the second heat exchanger, wherein the second heat exchanger acts as a condenser.

17. The system of claim 16, further comprising one or more of the following to monitor for the existence of frost upon surfaces of the first heat exchanger: a photoelectric sensor configured to monitor a surface of the first heat exchanger, an ice sensor configured to monitor the surface of the first heat exchanger, a temperature sensor configured to monitor the first heat exchanger, an air pressure sensor, a sensor configured to monitor the electrical power usage of the compressor, or one or more sensors that monitor parameters of the condenser that can be used by a controller to determine an amount of heat removed from the refrigerant within the condenser.

18. The system of claim 16, wherein the defrost function further comprises further opening the expansion valve to allow for increased refrigerant to flow through the expansion valve.

19. The system of claim 14, wherein the first space is an indoor space and the second space is an outdoor space.

20. The system of claim 14, wherein the first space is an outdoor space and the second space is an indoor space, wherein the system operates as a heat pump to transfer heat from the outdoor space to the indoor space.

* * * * *